US005833119A

United States Patent [19]

Kolacek

[11] Patent Number: 5,833,119

[45] Date of Patent: Nov. 10, 1998

[54] CONTAINER FOR PASTE AND GELS

[75] Inventor: Ivo Kolacek, Berwyn, Ill.

[73] Assignee: Liblan & Co., Inc., Wheeling, Ill.

[21] Appl. No.: 914,158

[22] Filed: Aug. 19, 1997

Related U.S. Application Data

[63] Continuation-in-part of Ser. No. 704,132, Aug. 28, 1996.

[51] Int. Cl.[6] ..... B67D 5/22

[52] U.S. Cl. ..... 222/41; 222/49; 222/107; 222/390

[58] Field of Search ..... 222/41, 46, 47, 222/49, 103, 105, 107, 390; 116/205

[56] References Cited

U.S. PATENT DOCUMENTS

| | | | |
|---|---|---|---|
| 2,284,218 | 5/1942 | Livingston | 222/49 |
| 2,477,875 | 8/1949 | Hutchason | 222/390 |
| 3,504,067 | 3/1970 | Trecek | 222/107 |
| 3,508,587 | 4/1970 | Mauch | 222/107 |

*Primary Examiner*—Philippe Derakshani
*Attorney, Agent, or Firm*—Hill & Simpson

[57] ABSTRACT

A container comprises a tubular body having a one end closed by an end member provided with a discharge opening receiving a cap and the other end being closed by a flattened second end. The end member is subdivided into a first portion containing the projection having the discharge opening and a second portion more pliable than the first portion so that the second portion can be collapsed into the first portion to applied pressure on the remaining contents in the end member during emptying the contents of the tube. Preferably, the tubular body has a pair of weakened zones extending the longitudinal length from adjacent the flat end member flattened into the end member to subdivide the body into two elongated portions which are aligned with the first and second portions of the end member. The container is particularly useful in a dispenser having a flattening member which progressively flattens the container to cause discharging of the contents thereof.

20 Claims, 3 Drawing Sheets

XIV
XIV
VII
VII
V
V

CONTAINER FOR PASTE AND GELS

CROSS-REFERENCE TO RELATED APPLICATIONS

The present application is a continuation in part of my allowed application U.S. Ser. No. 08/704,132 filed Aug. 28, 1996.

BACKGROUND OF THE INVENTION

FIELD OF THE INVENTION

The invention is directed to a improved container for paste and gels such as toothpaste and the container is particularly useful when used in a dispenser disclosed in my copending application Ser. No. 08/704,132 and to an improvement in the dispenser.

In my patent application Ser. No. 08/704,132 whose disclosure is incorporated by reference thereto, I disclosed a dispenser which allows easy dispensing of a fixed quantities of material such as toothpaste from a tube regardless of the amount of paste within the tube. In the two embodiments, of this dispenser a complete removal of all of the contents such as toothpaste from the tube was difficult due to the dispensing of the final remaining portion which was in an end member of the tube which member is formed of a rigid material in order to support a projection having the discharge opening. Thus, the piston or fattening member of the dispenser has difficulty flattening the end portion to expel that last remaining amount of the contents.

SUMMARY OF THE INVENTION

The present invention is directed to a container which is constructed so that the remaining amount of the contents in the end member of the container can be forced out of the discharge opening by deforming the end member. The inventions is also directed to an improvement in a dispenser for the contents of the container.

To accomplish this goal, the present invention is directed to a container comprising a tubular body having one end closed by an end member with a projection with a discharge opening receiving a removable cap for closing the opening, said tubular body being closed of the opposite end by a flattened second end, said end member being divided into first and second portions with the first portion including the projection and the second portion being more pliable than the first portion and deformable into the first portion so that after most of the content of the container has been removed any remaining amount of the contents in the end member can be forced out of the discharge opening by deforming the second portion into the first portion.

Preferably, in addition to the two portions of the end member, the tubular body is divided into first and second elongated portions by a pair of zones of weakness extending from adjacent edges of the flattened second end to the end member so that the second elongated portion can be progressively deformed into the first elongated portion as the contents of the tube is being ejected or forced through the discharge opening.

The structure of the container can be formed of a single material having the weakened portions molded in the two zones of the tubular body and the end member having the second portion being formed of a thinner material than the first portion to allow it to be deformed into the first portion. Thus, in addition to allowing substantially the complete removal of the entire contents of the container due to the deforming of the second portion of the end member into the first portion, only a single type of material is necessary for the container which is a benefit for manufacturing the container and makes the container recyclable to reduce waste.

The weakened zones can be formed by providing a weakened grooves on opposite sides of the tubular member and preferably it includes a group of three grooves with two external grooves and one internal groove which facilitate the folding and bending of the walls of the container when used in dispenser disclosed in my copending patent application. The second portion of the end member is preferably of a thinner material then the first portion so that it is more pliable and can either be constructed so that there is an outer ledge or step on the end member or an internal ledge or step on the end member.

Another feature of the invention is that the flattened second end is provided with a opening to allow hanging the container in displays and this opening may be offset by a perforated line so that once the container is removed, the portion with the opening is removed leaving two side portions which facilitate the threading of the container onto the piston or flattening member of the dispenser. In another modification of this, the flattened second end is formed with two side portions and an opening in the center.

The invention is also directed to one or more improvements in the dispenser which comprises a tubular body for receiving a tube having the projection at one end with the discharge opening closed by a removable cap, said body having a substantially cylindrical inner surface and two ends with one end being closed by an end member having an opening for receiving the projection when the tube is inserted into the tubular body, means for forcing the content of the tube out of the discharge opening of the tube, said means including a piston member received in the tubular body for movement therein to squeeze the tube against the portion of the inner surface and means for moving the member between a first position adjacent the other end of the two ends and a second position adjacent one end so that the movement of the piston member from the first position towards the second position progressively flattens the tube against the portion to force the content out of the discharge opening of the tube. The first improvement is means to provide an indication of the amount of contents forced from the tube said means comprising an indicator provided on one of the end member and the end of the tubular body adjacent the end member and a plurality of circumferentially spaced indices on the other of the end member and end of the tubular body so that with a rotation of the tubular body relative to the end member through a arc of a given size, the pointer moves from one indices to the next indices to indicate the amount of movement and thus the amount of discharge of contents. The second improvement is means for indicating that the piston member is approaching the second position to complete the emptying of the container. Either one of the two improvements may be included in the dispenser or both improvements may be incorporated therein.

Other advantages and features of the invention will be readily apparent from the following description of preferred embodiments, the drawings and claims.

DESCRIPTION OF THE PREFERRED EMBODIMENTS

Figures 1, 2, 3, 4:
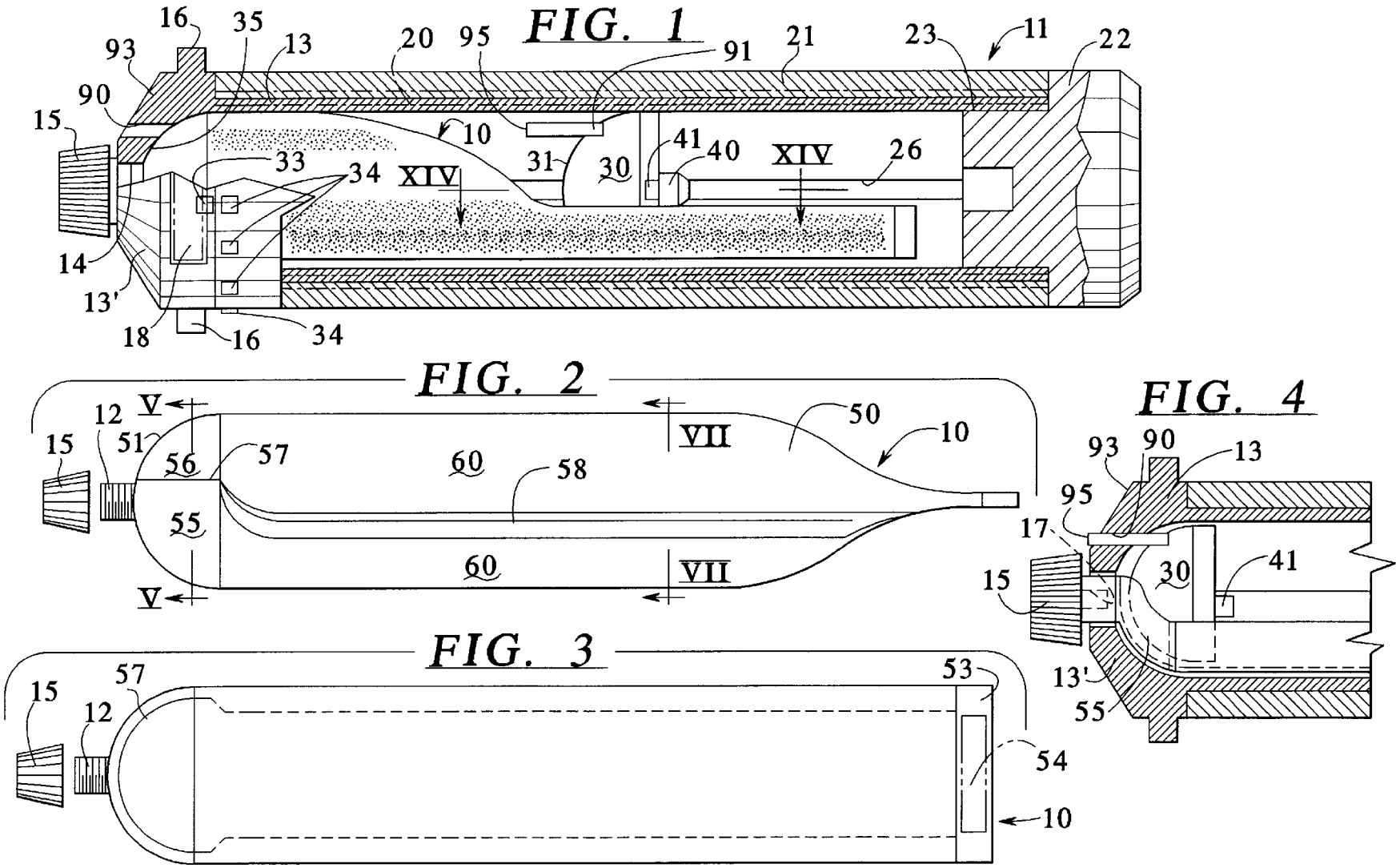
FIG. 1 is a partial longitudinal cross-sectional view with portions in elevations of an embodiment of a dispenser having a container in accordance with the present invention.
FIG. 2 is side view of the container illustrated in FIG. 1.
FIG. 3 is a top plan view of the container of FIG. 2.
FIG. 4 is a partial cross-sectional view showing the final discharge by the dispensers flattening the end member of the container of FIG. 2.

The principles of the present invention are particularly useful when incorporated in a container or tube generally indicated at 10 in FIGS. 2 and 3 which is particularly useful for use with a dispenser generally indicated at 11 in FIG. 1.

The dispenser 11 is described in detail in applicant's copending application Ser. No. 08/704,132. Briefly, the dispenser has a tubular body member 13 which has a closed end 13' with an aperture 14 at one end through which a neck or projection 12 on the container 10 extends. The neck 12 has external threads which receives a cap 15 and has an internal passage 17 which allows discharge of the contents of the tube. The member 13 has a pair of lugs 16 which will receive a fingerband (not illustrated).

As illustrated in FIG. 1, the member 13 has a sleeve portion 20 which receives an outer sleeve 21. At an opposite end, the sleeve portion 20 is connected to an end member or end plug 22 preferably by internal threads receiving threads on a portion 23 of the plug 22. The sleeve 21 is free to rotate on the sleeve portion 20 so that it rotates relative to the member 13, the sleeve portions 20 and the end plug 22. A piston or flattening member 30 is disposed within the cavity formed by the sleeve portion 20 and has a dome-shaped pressing surface 31 which matches a dome-shaped inner end surface 35 of a closed end 13' of the body member 13.

Figure 9:
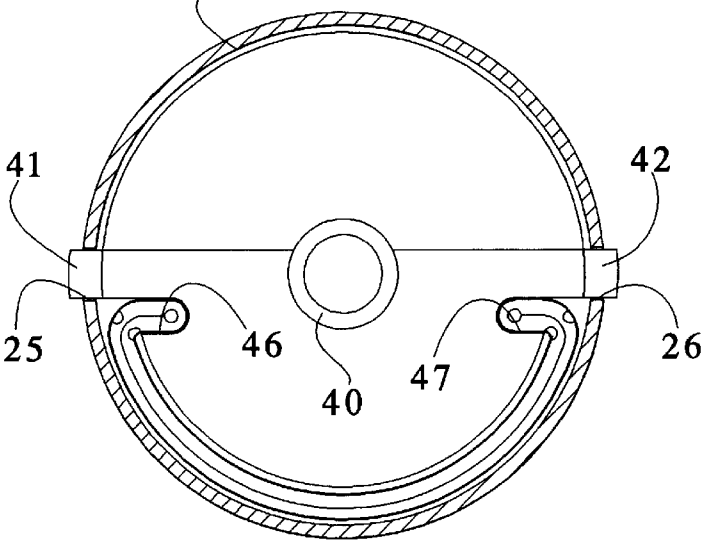
FIG. 9 is an end view showing the folding of the edges into the guide grooves of the flattening member.
Figure 14:
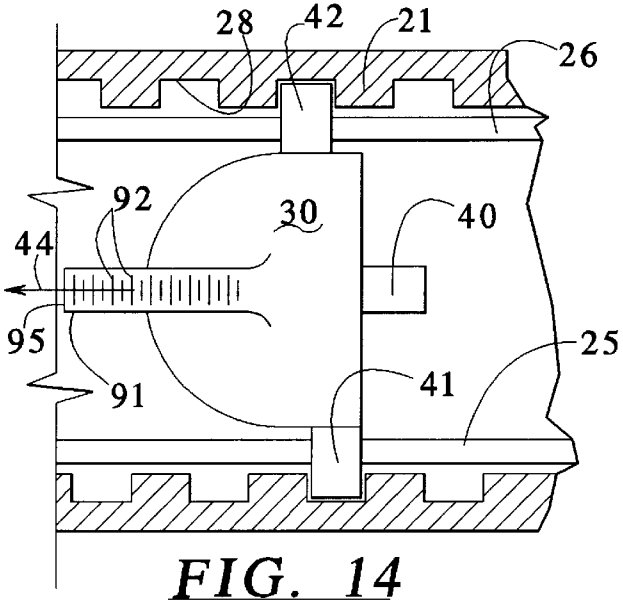
FIG. 14 is a partial cross-sectional view with portions in elevation taken along lines XIV—XIV of FIG. 1.
Figure 13:
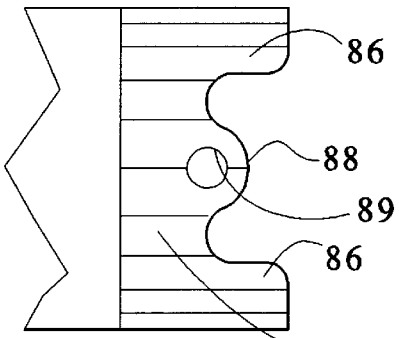
FIG. 13 is a partial plan view of a second modification of the flattened second end.

The piston 30 has a rear projection 40 and two oppositely positioned lugs 41 and 42 which are best shown in FIGS. 9 and 14. Sleeve portion 20 is provided with two longitudinal slots 25 and 26 with the slots 25 receiving the lug 41 and the slot 26 receiving the lug 42. The outwardly-extending lugs 41 and 42 extend through their respective slots 25 and 26 and are engaged in a helical track formed by a helical thread 28 (FIG. 14) in an internal surface of the sleeve 21. Thus, relative rotation of the sleeve 21 on the sleeve 20 will cause the pistons 30 to be moved in an axial direction within the sleeve. By selecting the pitch of the threads 28, the amount of axial movement per rotation can be selected. As illustrated in FIG. 14, the axial movement of portion 30 is approximate the thickness of the lugs such as 41 and 42. The slots such as 25 and 26 will constrain and prevent rotation of the piston 30 as the sleeve 21 is rotated and therefore causes an axial movement of the piston 30 within the dispenser.

An improvement of the present dispenser over those disclosed in the earlier application is the provision of a pointer 33 which is illustrated as being on the external surfaces of the closed end portion of the tubular body 13. A plurality of circumferentially spaced indicia 34 are spaced on the sleeve 21 with the arcuate distance between adjacent indicia designating a specific amount of rotation of the sleeve relative to the pointer 33. For example, if eight indicia are spaced around the surface, then the arcuate distance between adjacent indicia would be 45° or ⅛th of a rotation. Preferably the indicia are raised as is the pointer 33 so that a person visually impaired can tell how much the outer sleeve 21 has been rotated relative to the body portion 13 by counting the number of indicia that past the pointer 33. This enables the person to determine the amount of the contents being dispensed from the tube based on the amount of rotation of the outer sleeve 21 relative to the tubular body 13.

As in the device of the above-mentioned earlier application, the piston or flattening member 30 has a pair of grooves 46 and 47 which are positioned slightly below center line and which receive edges of the flattened container as illustrated in FIG. 9.

The container 10 (FIGS. 2 and 3) which has been particularly constructed for this dispenser has a tubular body 50 which at one end is closed by end member 51 having the projection 12 with the passage 17 forming a discharge opening. The opposite end of the container 10 has been flattened and as illustrated welded to form a closed flattened end 53.

Figure 6:
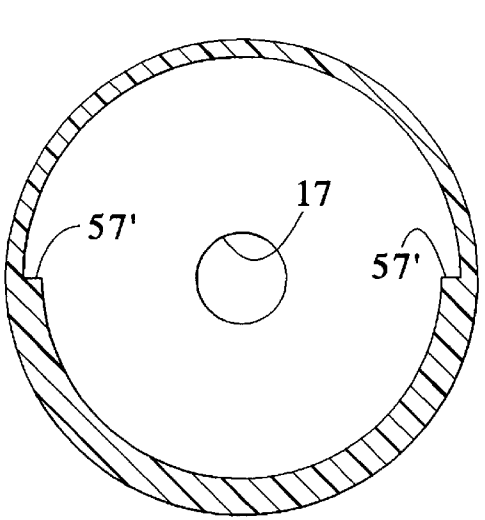
FIG. 6 is a modification of a cross-sectional view of FIG. 5.
Figure 5:
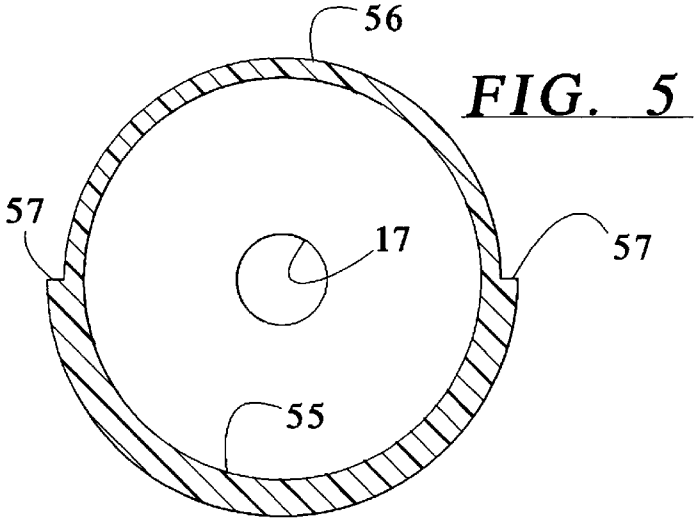
FIG. 5 is a cross-sectional view taken along lines V—V of FIG. 2.

The end member 51 as shown in FIGS. 2, 5 and 6 is composed of a first portion 55 which includes the projection 12 and a second portion 56 which is more pliable than the first portion 55. As illustrated in FIG. 5, the portion 56 has a thinner wall structure then the portion 55 with an external step or ledge such as 57 forming a line. It is also possible, that the step will be on the interior such as shown by the steps 57' of FIG. 6 so that the outer surface will be continuous convex or domed surface without any interruptions.

The tubular body 50 has a pair of oppositely spaced weaken zones 58 and 59 which extend from adjacent the flattened end 53 to the end member 51. Preferably, these weakened zones merge with the step 57 or 57' so that the tubular body 50 is formed into longitudinal extending or elongated portions 60 and 61 with the portion 60 being basically aligned with the first portion 55 of the end member and the portion 61 being aligned with the second portion 56 of the end member. Thus, as the piston or flattening member 30 is moved towards the closed end of the dispenser, the portions 61 is progressively collapsed into the portion 60 until the piston or flattening member 30 contacts the end member 51 which then has the second portion 56 collapsed into the first portion 55 to discharge the remaining contents of the tube through the opening 17.

Figure 8:
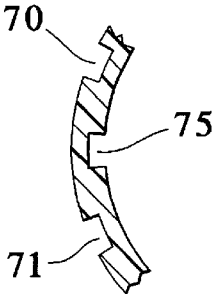
FIG. 8 is a partial cross-sectional view of a modification of the cross-section of FIG. 7.
Figure 7:
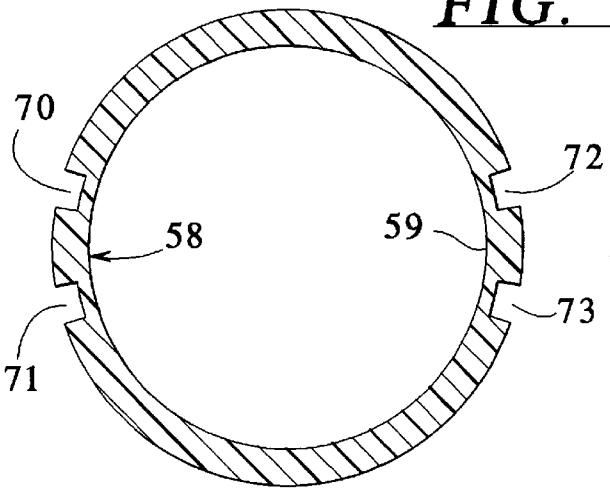
FIG. 7 is a cross-sectional view taken along lines VII—VII of FIG. 2.

To form the weaken zones 58 and 59, the wall portion of the tubular body 50 can be weakened by having a thin groove. In one embodiment illustrated in FIG. 7, the weaken zone 58 is formed by two grooves 70 and 71 and the weaken zone 59 is formed by two grooves 72 and 73. A preferred structure is each of the zones is formed by three grooves with two external grooves such as 70 and 71 as illustrated in FIG. 8 and an internal groove 75. This enables the flattened portion of the tubular body to be bent into the grooves 46 and 47 of the flattening member 30 as illustrated in FIG. 9.

While the embodiment illustrated in FIG. 2 has the weakened zones such as 58 having a curved portion adjacent the step 57, it is possible to have the weakened zones extending the substantially in a straight line between the step portion 57 and the flattened end 53.

In the illustrated embodiment, a label 18 has been provided on an outer surface of the body portion 13 and a label such as 54 has been provided on the flattened end 53. Each of these labels can contain information about the part and the instructions can be provided in brail for a person who is visually impaired.

As mentioned earlier, one of the features of Applicant's container is to provide a container which requires a small amount of material which material is all of the same type so that it is easily recycled and only involves a small amount of material if recycling is not accomplished. Thus, the container is formed of a suitable plastic such as low density polyethylene which is marked in category 4 for easy recycling. It is also can be FDA approved material for food and/or toothpaste containers such as sold under the trademark SARAN.

Figure 10:
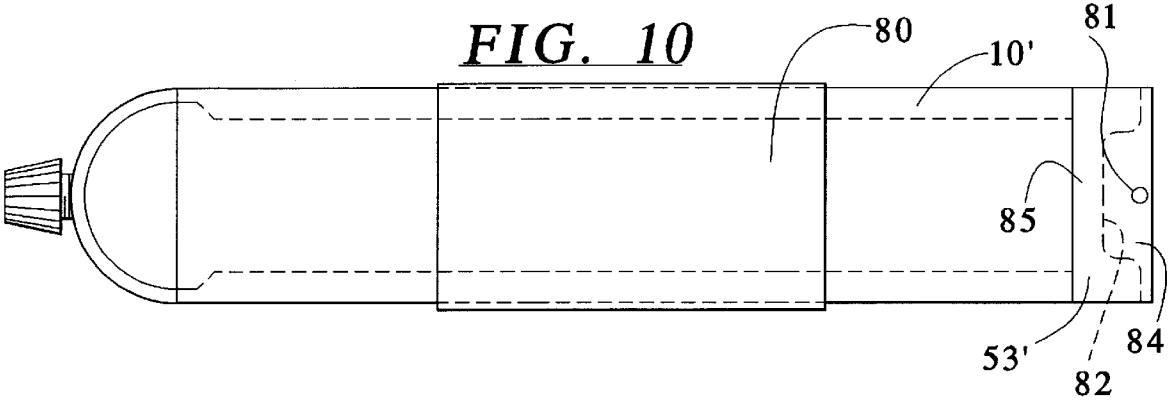
FIG. 10 is a plan view similar to FIG. 3 of a modified container in accordance with the present invention.
Figure 11:
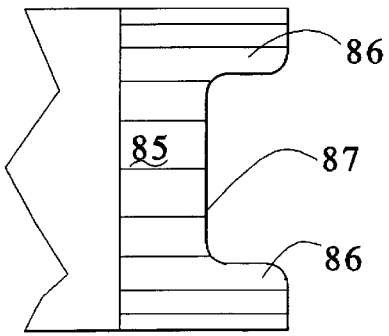
FIG. 11 is an enlarged view with a portion of the flattened member second end removed.

In order to further reduce the wrapping material, it is possible to provide a label such as the label 80 illustrated in FIG. 10 which label can either be a piece of plastic shrunk onto the tube or a paper label. The container 10' of FIG. 10 has a specially configured flattened end 53' which is provided with an opening 81 and a die cut line 82. The opening 81 can be used for hanging the containers in a display and the die cut 82 separates the flattened end 53' into a throw-away portion 84 and the remaining portion 85. As illustrated in FIG. 11, the remaining portion 85 has two side projections 86, 86 separated by a recess 87. The projections 86 aid in threading the flattened edge of container 10' into the slots or grooves such as 46 of the flattening member 30 as the container 10' is loaded into a dispenser 11.

In another modification, the flattened portion 53" instead of having the die cut portions or line 82 as the side projections 86, 86 and a center projection 88 having an opening 89 for hanging the container.

Figure 12:
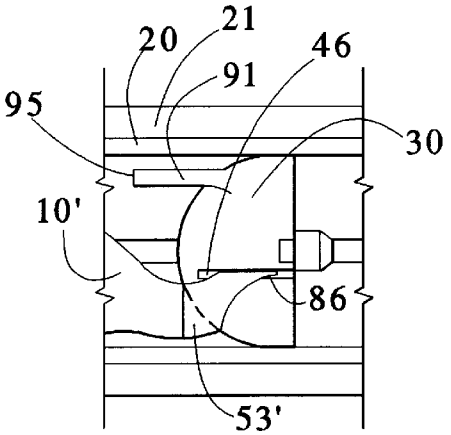
FIG. 12 is a partial cross-sectional view similar to FIG. 1 showing the initial threading of the flattened second end into the grooves of the flattening member.

With these embodiments illustrated in FIGS. 10, 11 and 12, external boxes or packaging is eliminated which will greatly reduce the packaging material and thus waste materials to be placed in a land fill. It is noted, that if the label 80 is a shrink wrap label, it can be easily removed from the remaining container so that the empty container can be recycled.

It is contemplated, that the container can be used for various products such as toothpaste, paste-like foods or gel-like materials such as hand soaps or shampoos. It should be pointed out, that while toothpaste is considered to be one of the main contents to be held in the container, the container is not limited solely for toothpaste.

Another improvement of the dispenser 11 over the dispenser of the earlier-filed application is the provision of means for indiciating the approach of the piston member 30 to a position adjacent the closed end 13' of the body member 13. This means includes an aperture or opening 90 in the closed end 13' and a projection 91 on the piston member 30, which projection is aligned to extend through the opening as the piston member 30 comes into the second end position, which collapses the second portion 56 of the end member 51 of the container or tube 10 into the first portion 55.

Until the second portion 56 is collapsed into the first portion 55, the portion 56 will cover the opening 90, as illustrated in FIG. 1. As the piston member 30 approaches the end member 13', the portion 56 begins to be bent away from the inner surface 35 of the end member 13' to expose the opening 90. The length of the projection 91 is selected so that it will not extend into the area occupied by the second portion 56 until the portion 56 has been bent or collapsed out of the way to start to expose the opening 90. Once the opening 90 is exposed, then the projection 91 is free to move into the opening 90, and when an end 95 of the projection 91 becomes flush with the outer surface 93 of the end member 13', an indication that the piston is approaching the first position is provided. As illustrated in FIG. 4, the length of the projection 91 is such that when the piston is in the final position for collapsing the portion 56 into the portion 55, a prescribed length of the projection 91 extends past the surface 93. As illustrated in FIG. 14, if indicia 92 are provided, the operator of the dispenser can determine approximately how many more turns can be applied before the piston will bottom-out in the final end position. The indicia can be a series of colored lines or can be raised bumps or ridges which enable a person who is visually-impaired to determine how much more the sleeve 21 can be turned. This arrangement, in addition to indicating that the container 10 is almost empty, also provides a warning to prevent overturning the sleeve 21 relative to the tube portion 20 to damage the parts by applying too much pressure on the piston member 30 against the domed inner end surface 35 of the closed end 13' of the body member 13.

Although various minor modifications may be suggested by those versed in the art, it should be understood that I wish to embody within the scope of the patent granted hereon all such modifications as reasonably and properly come within the scope of my contribution to the art.

I claim:

1. A container comprising a tubular body having one end closed by an end member with a projection with a discharge opening receiving a removable cap for closing the opening, said tubular body being closed at an opposite end by a flattened second end portion, said end member being divided into first and second portions with the first portion including the projection and the second portion being more pliable than the first portion and deformable into the first portion so that after most of the contents of the container have been removed, any remaining amount of the contents in the end member can be forced out of the discharge opening by deforming the second portion into the first portion.

2. A container according to claim 1, wherein said tubular body is divided into first and second elongated portions by a pair of zones of weakness extending from portions adjacent the edges of the flattened second end portion to the end member.

3. A container according to claim 2, wherein the ends of the pair of zones of the weakness are aligned with a line separating the first and second portions of the end member so that a second elongated portion of the tubular body is aligned with the second portion of the end member.

4. A container according to claim 2, wherein each of the zones of weakness is formed by two grooves disposed on an outer surface of the tubular body.

5. A container according to claim 2, wherein each of the zones of weakness is formed by a first groove on an internal surface of the tubular body and a pair of grooves on the outer surface of the tubular body spaced on opposite sides of the first groove.

6. A container according to claim 2, wherein the flattened end portion terminates in a curved edge forming a pair of side projections with an recess therebetween.

7. A container according to claim 6, wherein the flattened end portion includes an opening to enable hanging the container in a display.

8. A container according to claim 2, which include the flattened end portion having a die cut portion separating the flattened end portion into a first flattened portion adjacent the tubular body and a second flattened portion spaced by the first portion from the tubular body, said first flattened portion having side projections extending axially into the second flattened portion so that with removal of the second flattened portion, the first flattened portion has the two axially extending side portions separated by a recess.

9. A container according to claim 8, wherein the second flattened portion is provided with an opening to enable hanging the container in a display.

10. A container according to claim 2, wherein the second portion of the end member is thinner than the first portion of the end member forming a step therebetween.

11. A container according to claim 10, wherein said step is on an exterior surface of the end member.

12. A container according to claim 10, wherein the step is disposed on an interior surface of the end member and the external surface of end member is a continuous domed surface.

13. A container according to claim 1, wherein the end member is a dome-shaped and the second portion has a wall thickness less than the first portion to form a joinder thereof.

14. A container according to claim 13, wherein the step is disposed on an exterior surface so that an internal surface of the end member is a continuous concave dome surface.

15. A container according to claim 13, wherein the step is disposed on an internal surface of the end member so that the first and second portions of the end member form a continuous curved domed surface.

16. A dispenser comprising a tubular body for receiving a tube having a projection at one end with a discharge opened and closed by a removable cap, said body having a substantial cylindrical inner surface and two ends with one end being closed by an end member having an opening for receiving the projection when the tube is inserted into the tubular body, means for forcing the content of the tube out of the discharge opening of the tube, said means including a piston member received in the tubular body for movement therein to squeeze the tube against the portion of the inner surface, means for moving the piston member between a first position adjacent the other end of the two ends and a second position adjacent the one end so that movement of the piston member from the first position towards the second position progressively flattens the tube against said portion to force the content out of discharge opening of the tube, said means for moving including a sleeve rotatably mounted on the tubular body, and one of said sleeve and tubular body having a pointer, and the other of said sleeve and tubular body having circumferentially spaced indicia adjacent the pointer so that an angular amount of rotation of the sleeve relative to the tubular body can be determined.

17. A dispenser according to claim 16, wherein the indicia and pointer are each raised so that they can be recognized by touch.

18. A dispenser according to claim 16, which includes means for indicating the piston member approaching the second position.

19. A dispenser comprising a tubular body for receiving a tube having a projection at one end with a discharge opened and closed by a removable cap, said body having a substantial cylindrical inner surface and two ends with one end being closed by an end member having an opening for receiving the projection when the tube is inserted into the tubular body, means for forcing the content of the tube out of the discharge opening of the tube, said means including a piston member received in the tubular body for movement therein to squeeze the tube against the portion of the inner surface, means for moving the member between a first position adjacent the other end of the two ends and a second position adjacent the one end so that movement of the piston member from the first position towards the second position progressively flattens the tube against said portion to force the content out of discharge opening of the tube, said means for moving including a sleeve rotatably mounted on the tubular body, and means for indicating that the piston member is approaching said second position.

20. A dispenser according to claim 19, wherein said means for indicating includes an opening in the end member and a projection on the piston member aligned with the opening so that as the piston member approaches the second position, said projection enters the opening and becomes visible from the outside of the dispenser.

* * * * *